US008336927B2

(12) United States Patent
Liang et al.

(10) Patent No.: US 8,336,927 B2
(45) Date of Patent: Dec. 25, 2012

(54) TILT LATCH WITH CANTILEVERED ANGULAR EXTENSION

(76) Inventors: Luke Liang, South Plainfield, NJ (US); Toni Liang, Jiefangbei (CN); Toug Liang, Guangzhou (CN); David Chen, Guangzhou (CN)

( * ) Notice: Subject to any disclaimer, the term of this patent is extended or adjusted under 35 U.S.C. 154(b) by 1121 days.

(21) Appl. No.: 12/228,889

(22) Filed: Aug. 15, 2008

(65) Prior Publication Data

US 2010/0038918 A1 Feb. 18, 2010

(51) Int. Cl.
*E05C 1/08* (2006.01)

(52) U.S. Cl. ..... 292/163; 292/DIG. 47

(58) Field of Classification Search ..... 292/163, 292/175, DIG. 47, DIG. 53
See application file for complete search history.

(56) References Cited

U.S. PATENT DOCUMENTS

| | | | |
|---|---|---|---|
| 4,066,284 | A | 1/1978 | Ikemura |
| 4,102,546 | A | 7/1978 | Costello |
| 4,137,671 | A | 2/1979 | Miller |
| 4,223,930 | A | 9/1980 | Costello et al. |
| 4,235,465 | A | 11/1980 | Costello |
| 4,301,622 | A | 11/1981 | Dunsmoor |
| 4,320,597 | A | 3/1982 | Sterner, Jr. |
| 4,356,667 | A | 11/1982 | Malachowski |
| 4,395,847 | A | 8/1983 | Atchison |
| 4,400,026 | A | 8/1983 | Brown, Jr. |
| 4,475,311 | A | 10/1984 | Gibson |
| 4,553,353 | A | 11/1985 | Simpson |
| 4,578,903 | A | 4/1986 | Simpson |
| 4,635,396 | A | 1/1987 | Ranz et al. |
| D295,019 | S | 4/1988 | Bocson |
| 4,791,756 | A | 12/1988 | Simpson |
| 4,837,975 | A | 6/1989 | Simpson |
| 4,887,392 | A | 12/1989 | Lense |
| 4,888,915 | A | 12/1989 | Goldenberg |
| 4,901,475 | A | 2/1990 | Simpson |
| 4,924,930 | A | 5/1990 | Drennan |
| 4,953,372 | A | 9/1990 | Lovell et al. |
| 4,961,286 | A | 10/1990 | Bezubic |
| 4,974,887 | A | 12/1990 | Pucci |
| 4,976,066 | A | 12/1990 | Plummer et al. |
| 5,069,483 | A | 12/1991 | Hirasawa |
| 5,119,591 | A | 6/1992 | Sterner, Jr. et al. |
| 5,121,951 | A | 6/1992 | Harbom et al. |
| 5,139,291 | A | 8/1992 | Schultz |
| 5,165,737 | A | 11/1992 | Riegelman |
| 5,167,131 | A | 12/1992 | Karkhanis |
| 5,168,665 | A | 12/1992 | Goldenberg |
| 5,274,955 | A | 1/1994 | Dallaire et al. |
| 5,406,749 | A | 4/1995 | Goldenberg |

(Continued)

*Primary Examiner* — Gary Estremsky
(74) *Attorney, Agent, or Firm* — Thomas A. O'Rourke; Bodner & O'Rourke, LLP

(57) ABSTRACT

A latch is provided for use on a pivotable sash window of a single-hung or double-hung sash window assembly to releasably secure the window to the master frame. The latch comprises a latch-bolt slidably mounted within, and biased relative to a housing. The housing is adapted to be installed into the top rail of the sash window through an opening in the stile and top rail, which has a periphery contoured to match the housing end profile. The latch bolt, while maintaining an aesthetically appealing external appearance, is configured to incorporate a cantilevered member which only becomes visible when biased to an angled position where it maintains engagement of the latch housing with the edge of the top wall of the rail during window deformation resulting from high wind loading. The cantilevered member ensures integrity of the latch installation under high wind load conditions typically experienced during extreme weather phenomena.

17 Claims, 6 Drawing Sheets

U.S. PATENT DOCUMENTS

| | | | | |
|---|---|---|---|---|
| 5,592,781 | A | 1/1997 | Mauro | |
| 5,620,214 | A | 4/1997 | Kondratuk | |
| 5,669,639 | A | 9/1997 | Lawrence | |
| 5,671,958 | A * | 9/1997 | Szapucki et al. | 292/175 |
| 5,715,631 | A | 2/1998 | Kailian et al. | |
| 5,901,501 | A | 5/1999 | Fountaine | |
| 5,927,014 | A | 7/1999 | Goldenberg | |
| 6,178,696 | B1 | 1/2001 | Liang | |
| 6,311,439 | B1 | 11/2001 | Arcati et al. | |
| 6,364,375 | B1 | 4/2002 | Szapucki et al. | |
| 6,506,112 | B1 | 1/2003 | Halbleib et al. | |
| 6,546,671 | B2 | 4/2003 | Mitchell et al. | |
| 6,565,133 | B1 | 5/2003 | Timothy | |
| 6,567,708 | B1 | 5/2003 | Bechtel et al. | |
| 6,572,158 | B2 | 6/2003 | Szapucki et al. | |
| 6,607,221 | B1 | 8/2003 | Elliott | |
| 6,679,001 | B1 | 1/2004 | Guelck | |
| 6,827,376 | B2 * | 12/2004 | Fountaine | 292/98 |
| 6,829,511 | B2 | 12/2004 | Bechtel et al. | |
| 6,871,885 | B2 | 3/2005 | Goldenberg et al. | |
| 6,968,646 | B2 | 11/2005 | Goldenberg et al. | |
| 7,085,609 | B2 | 8/2006 | Bechtel et al. | |
| 7,096,626 | B2 * | 8/2006 | Heng et al. | 49/185 |
| 7,147,255 | B2 | 12/2006 | Goldenberg et al. | |
| 7,159,908 | B2 | 1/2007 | Liang | |
| 7,261,330 | B1 | 8/2007 | Hauber | |
| 7,296,381 | B1 | 11/2007 | McCabe et al. | |
| 7,322,619 | B2 | 1/2008 | Nolte et al. | |
| 7,363,747 | B2 | 4/2008 | Heck et al. | |
| 7,407,199 | B2 | 8/2008 | Richardson | |
| 7,494,164 | B1 | 2/2009 | Garries et al. | |
| 7,520,541 | B1 | 4/2009 | Lawrence | |
| 7,533,496 | B2 | 5/2009 | Tremble et al. | |
| 7,542,809 | B2 | 6/2009 | Bechtel et al. | |
| 7,571,568 | B2 | 8/2009 | Ito et al. | |
| 7,578,560 | B2 | 8/2009 | Spence, Jr. | |
| 7,579,802 | B2 | 8/2009 | Boisvert et al. | |
| 7,579,939 | B2 | 8/2009 | Schofield et al. | |
| 7,579,940 | B2 | 8/2009 | Schofield et al. | |
| 7,580,019 | B2 | 8/2009 | Hong et al. | |
| 7,580,100 | B2 | 8/2009 | Choi et al. | |
| 7,583,184 | B2 | 9/2009 | Schofield et al. | |
| 7,583,245 | B2 | 9/2009 | Kwon | |
| 7,584,577 | B2 | 9/2009 | Esmond et al. | |
| 7,584,976 | B2 | 9/2009 | Bayne et al. | |
| 7,584,998 | B2 | 9/2009 | Richter et al. | |
| 7,585,264 | B1 | 9/2009 | Wang et al. | |
| 7,585,277 | B2 | 9/2009 | Taylor et al. | |
| 7,585,747 | B1 | 9/2009 | Chen | |
| 7,586,600 | B2 | 9/2009 | Kao et al. | |
| 7,587,787 | B2 | 9/2009 | Pettit | |
| 7,587,886 | B1 | 9/2009 | Sugden | |
| 7,588,225 | B2 | 9/2009 | Wawerski | |
| 7,591,103 | B2 | 9/2009 | Tremble et al. | |
| 7,591,626 | B2 | 9/2009 | Curtis et al. | |
| 7,592,973 | B2 | 9/2009 | Choi | |
| 7,593,782 | B2 | 9/2009 | Jobs et al. | |
| 7,595,244 | B1 | 9/2009 | Bulucea et al. | |
| 7,596,902 | B2 | 10/2009 | Han et al. | |
| 7,597,290 | B2 | 10/2009 | Sugiura et al. | |
| 7,600,468 | B2 | 10/2009 | Zhang et al. | |
| 7,600,684 | B2 | 10/2009 | Tobin et al. | |
| 7,600,796 | B2 * | 10/2009 | Liang et al. | 292/338 |
| 7,601,066 | B1 | 10/2009 | Masuyama et al. | |
| 7,601,298 | B2 | 10/2009 | Waldo et al. | |
| 7,602,230 | B2 | 10/2009 | Castaldo et al. | |
| 7,603,726 | B2 | 10/2009 | Sawalski et al. | |
| 7,605,590 | B2 | 10/2009 | Mulcahey | |
| 7,605,786 | B2 | 10/2009 | Yamazaki | |
| 7,605,940 | B2 | 10/2009 | Silverbrook | |
| 7,606,411 | B2 | 10/2009 | Venetsky et al. | |
| 7,606,552 | B2 | 10/2009 | Orr et al. | |
| 7,607,262 | B2 | 10/2009 | Pettit et al. | |
| 7,607,573 | B1 | 10/2009 | Gromley et al. | |
| 7,607,623 | B2 | 10/2009 | Wesolowski et al. | |
| 7,608,847 | B2 | 10/2009 | Rees | |
| 7,610,637 | B2 | 11/2009 | Menkedick et al. | |
| 7,610,639 | B2 | 11/2009 | Roleder et al. | |
| 7,610,739 | B2 | 11/2009 | Godfrey | |
| 7,610,821 | B2 | 11/2009 | Klein | |
| 7,611,126 | B2 | 11/2009 | Vesa | |
| 7,611,204 | B2 | 11/2009 | Reed et al. | |
| 7,611,500 | B1 | 11/2009 | Lina et al. | |
| 7,612,307 | B2 | 11/2009 | Chou et al. | |
| 7,612,392 | B2 | 11/2009 | Jung et al. | |
| 7,612,856 | B2 | 11/2009 | Otose et al. | |
| 7,976,077 | B2 * | 7/2011 | Flory et al. | 292/36 |
| 2002/0070565 | A1 | 6/2002 | Szapucki et al. | |
| 2002/0145291 | A1 | 10/2002 | Goldenberg et al. | |
| 2003/0024168 | A1 | 2/2003 | Mitchell et al. | |
| 2003/0145532 | A1 | 8/2003 | Kownacki et al. | |
| 2003/0191546 | A1 | 10/2003 | Bechtel et al. | |
| 2004/0000093 | A1 | 1/2004 | Guelck | |
| 2004/0036299 | A1 | 2/2004 | Goldenberg et al. | |
| 2004/0036300 | A1 | 2/2004 | Goldenberg et al. | |
| 2004/0226208 | A1 | 11/2004 | Kownacki et al. | |
| 2004/0262929 | A1 | 12/2004 | Trickel | |
| 2005/0028446 | A1 | 2/2005 | Fullick | |
| 2005/0063036 | A1 | 3/2005 | Bechtel et al. | |
| 2005/0144845 | A1 | 7/2005 | Heck et al. | |
| 2006/0033345 | A1 | 2/2006 | Richardson | |
| 2006/0087130 | A1 | 4/2006 | Liang | |
| 2006/0207200 | A1 | 9/2006 | Arias | |
| 2006/0284424 | A1 | 12/2006 | Newbould et al. | |
| 2007/0029810 | A1 | 2/2007 | Nolte et al. | |
| 2007/0046031 | A1 | 3/2007 | Goldenberg et al. | |
| 2007/0067048 | A1 | 3/2007 | Bechtel et al. | |
| 2007/0157521 | A1 | 7/2007 | Ito et al. | |
| 2007/0158953 | A1 | 7/2007 | Liang | |
| 2007/0175252 | A1 | 8/2007 | Ramsauer | |
| 2007/0186478 | A1 | 8/2007 | Ozawa | |
| 2007/0194578 | A1 | 8/2007 | Boosey et al. | |
| 2007/0227075 | A1 | 10/2007 | Tremble et al. | |
| 2007/0271735 | A1 | 11/2007 | Ramsauer | |
| 2007/0289220 | A1 | 12/2007 | Vilhauer | |
| 2008/0053623 | A1 | 3/2008 | Goldenberg et al. | |
| 2008/0060401 | A1 | 3/2008 | Ramsauer | |
| 2008/0072532 | A1 | 3/2008 | Arias | |
| 2008/0129054 | A1 | 6/2008 | Tremble et al. | |
| 2008/0163551 | A1 | 7/2008 | Nolte et al. | |
| 2008/0168715 | A1 | 7/2008 | Titus | |
| 2008/0179896 | A1 | 7/2008 | Chung | |
| 2008/0295416 | A1 | 12/2008 | Kintz | |
| 2008/0296916 | A1 | 12/2008 | Kintz | |
| 2008/0302017 | A1 | 12/2008 | Phillips | |
| 2009/0066093 | A1 | 3/2009 | Garries et al. | |
| 2009/0079202 | A1 | 3/2009 | Wolf | |
| 2009/0113800 | A1 | 5/2009 | Garries et al. | |
| 2009/0173009 | A1 | 7/2009 | Garries et al. | |
| 2009/0199495 | A1 | 8/2009 | Garries et al. | |
| 2009/0199496 | A1 | 8/2009 | Garries et al. | |
| 2009/0204269 | A1 | 8/2009 | Bechtel | |
| 2009/0217720 | A1 | 9/2009 | Herdman | |
| 2009/0218363 | A1 | 9/2009 | Terzini | |
| 2009/0223130 | A2 | 9/2009 | Ozawa | |
| 2009/0224585 | A1 | 9/2009 | Bokelmann et al. | |
| 2009/0236834 | A1 | 9/2009 | Turner | |
| 2009/0239293 | A1 | 9/2009 | Sandell | |
| 2009/0240282 | A1 | 9/2009 | Mayer | |
| 2009/0241263 | A1 | 10/2009 | DeBraal et al. | |
| 2009/0241275 | A1 | 10/2009 | Johnson et al. | |
| 2009/0241284 | A1 | 10/2009 | Mayes et al. | |
| 2009/0241289 | A1 | 10/2009 | Choi et al. | |
| 2009/0241429 | A1 | 10/2009 | Polowinczak et al. | |
| 2009/0242002 | A1 | 10/2009 | Garman | |
| 2009/0242882 | A1 | 10/2009 | Leung et al. | |
| 2009/0243359 | A1 | 10/2009 | Yoshida et al. | |
| 2009/0249533 | A1 | 10/2009 | Sawalski et al. | |
| 2009/0249694 | A1 | 10/2009 | Nilsson | |
| 2009/0250574 | A1 | 10/2009 | Fullerton et al. | |
| 2009/0250575 | A1 | 10/2009 | Fullerton et al. | |
| 2009/0250576 | A1 | 10/2009 | Fullerton et al. | |
| 2009/0251255 | A1 | 10/2009 | Fullerton et al. | |
| 2009/0251256 | A1 | 10/2009 | Fullerton et al. | |
| 2009/0251394 | A1 | 10/2009 | Ahn et al. | |
| 2009/0251451 | A1 | 10/2009 | Cha et al. | |
| 2009/0255681 | A1 | 10/2009 | Spencer | |

2009/0257110 A1 10/2009 Ichikawa et al.
2009/0261565 A1 10/2009 David et al.
2009/0261626 A1 10/2009 Troutman et al.
2009/0263142 A1 10/2009 Shen
2009/0263947 A1 10/2009 Hebert
2009/0265050 A1 10/2009 Burpee
2009/0265972 A1 10/2009 Chang
2009/0265991 A1 10/2009 Ito et al.
2009/0265996 A1 10/2009 Flory
2009/0265997 A1 10/2009 Flory
2009/0266354 A1 10/2009 Chen
2009/0266842 A1 10/2009 Snodgrass
2009/0267315 A1 10/2009 Suddaby et al.
2009/0267376 A1 10/2009 McDermott
2009/0267878 A1 10/2009 Song et al.
2009/0269933 A1 10/2009 Yamaguchi et al.
2009/0272035 A1 11/2009 Boisvert et al.
2009/0273214 A1 11/2009 Shields et al.
2009/0273422 A1 11/2009 Fullerton et al.
2009/0273424 A1 11/2009 Fullerton et al.
2009/0273440 A1 11/2009 Marschalek et al.
2009/0273553 A1 11/2009 Song et al.
2009/0273555 A1 11/2009 Song et al.
2009/0273557 A1 11/2009 Song et al.
2009/0273825 A1 11/2009 Ichikawa et al.
2009/0275170 A1 11/2009 Chen

* cited by examiner

TILT LATCH WITH CANTILEVERED ANGULAR EXTENSION

FIELD OF THE INVENTION

This invention relates to a tilt latch mechanism for use in a pivotable sash window, and more particularly to a latch housing designed for ease of installation while ensuring integrity of the latch installation during window deformation accompanying high wind loads.

BACKGROUND OF THE INVENTION

The traditional style of windows used in the United States, and many other places that had been colonized by the English, is the single-hung and the double-hung sash window. A Double-hung window assembly typically comprises two sash windows each of which slide vertically in a master frame. To enable a user to easily open or close such windows, as well as to enable the window to remain static once it has been opened or closed, a balance assembly is attached to each window. Such balance assemblies were originally just counterweights on either side of the window, where the weights were suspended by a cord or chain across a pulley and attached to the sash window.

Advances in window construction have been significant, and although contemporary windows may visually resemble their ancestor described above, a resemblance which may even permit its use as a replacement window in historic homes, the technological improvements render them very different as to the materials used, and vastly superior in terms of performance. Many of the changes have been due in part to the demand for greater energy efficiency in both hotter and colder climates, where the savings attributable to reductions in the corresponding air-conditioning or heating expenses can be considerable.

Increases in thermal efficiency have been made through the use of an Insulating Glass Unit (IGU) or double-paned window, in which two panes of glass are hermetically sealed to form a single glazed unit, with an 'air-space' between the two panes of glass. This arrangement, also known as "double-glazing," generally reduced or eliminated the problem of windows fogging or frosting, and of the windows being uncomfortably cold upon contact. Further improvement were made by filling the 'air-space' with inert gases, such as argon and krypton, both of which have a higher resistance to heat flow than does air. Additional thermal resistance of an IGU has also been achieved through the use of low-emissivity coatings, which are typically applied to the non-exposed, interior side of the glass pane or panes. The coatings can be alternatively designed for a high or low solar heat gain coefficient (SHGC), depending on the location's requirements, while simultaneously reducing the window's u-factor, or rate at which the unit conducts infrared radiation (non-solar heat) from a warm pane of glass to a cooler pane of glass.

Despite these tremendous advances, a further consideration as to the overall energy efficiency of a window is that the window's frame constitutes roughly 25% of its area, making its conductivity a substantial factor in the window's energy performance. Wood frame windows are still widely available, however, the maintenance drawbacks of solid wood windows has led to some of the material upgrades previously mentioned, as frames have become available in the form of vinyl-clad and aluminum-clad wood, and such frames actually comprise a major share of the market. Not surprisingly, the market for energy conductive aluminum frame windows is relatively small. But a large intermediate share is held by insulated vinyl and insulated fiberglass frame windows which are among the best energy performers.

Advances have similarly been made in the associated window hardware, including the latch which enables a sash window to not only move vertically, but to pivot inwardly as well. One such latch is shown by U.S. Pat. No. 5,139,291 to Schultz. The latch is adapted for installation into a window having a hallow top sash rail. The latch housing has a "side wall rail," which, in combination with the housing cover edge, forms a groove, where the groove cooperates with the edge of the top wall of the top sash rail to retain the latch. The latch slides into a side opening in the sash window stile, which has a periphery to match the latch profile. A tab on the front face of the latch engages the stile to retain the tilt latch in position.

However, many if not most coastal areas now mandate that the windows installed be constructed to satisfy very stringent standards. These standard may include a requirement that the window be able to structurally withstand, for a set period of time, a specified design pressure, which would permit the window to maintain its integrity throughout the sustained winds of a category five hurricane. Under such loading, it is not uncommon to see a window convex a couple of inches, but when properly designed, the window will regain its original form. This significant deformation under such high wind loads creates as serious if not fatal problem for the hardware currently available, particularly the tilt latch. The Schultz tilt latch would not be retained by the sash rail as described above, when the window experienced high wind loading and deformation, especially in the case of a vinyl frame window, which lacks the structural rigidity of the energy inefficient aluminum frame window.

It is possible to utilize the top plate of the latch to restore some of the frame's structural rigidity, and may be accomplished in the approach shown in FIG. 3 of U.S. Pat. No. 7,069,694 to Fullick. The top plate in Fullick widens to permit the installation of mechanical fasteners which connect the top plate to the opposite sides of the top wall of the top rail. Although this approach would help to limit the local window frame deformation which would impair the integrity of the latch installation during loading and deformation occurring in extreme weather conditions, it requires additional parts and manufacturing operations not needed with the Schultz configuration. The Fullick design also affects the aesthetic appearance of the latch, which is a significant factor in a competitive market where such a tradeoff, for the most part, may not enhance overall value to the consumer because statistically speaking, the ability of the latch to satisfy high wind loading conditions of extreme weather phenomena will seldom be utilized.

Also, the latch in U.S. Pat. No. 5,671,958 to Szapucki has resilient tabs 18, 18', 20, and 20', as shown in its FIG. 12, which permit a drop down latch installation into the top rail of the window, rather than an installation endwise through an opening in the stile. These tabs in Szapucki are designed to be resilient so that they snap outwardly under the edges of the top plate. The tabs may assist in keeping the latch in place while the window experiences some minor deformation associated with ordinary use and loading, but the tabs are extremely limited by their design and inherent ability to withstand large scale deformations that accompany the high wind loading conditions.

The invention disclosed herein provides a more advanced and unique concept for installation than provided by Schultz, and without the inherent drawbacks created by incorporation of the Fullick top plate and fasteners. This invention furthermore overcomes the limitations posed by attempting to use other existing designs represented by the Szapucki patent.

SUMMARY OF THE INVENTION

The latch of this invention is designed to be able to maintain the integrity of a latch installation and its functionality, even when a window undergoes substantial deformation, which may occur as a result of the high sustained winds experienced during hurricanes, as well as the high winds associated with other extreme weather phenomena. The latch features disclosed herein may be utilized on number of different latch types, but they are particularly useful for a latch to be installed on the sash window of a tiltable single-hung or double hung window assembly.

The latch of this invention comprises a latch housing, which may comprise a pair of side walls extending down from a top plate, where the top plate extends beyond the side wall and may be used to install the latch onto the top rail of a hung window. Although not required, the housing may further comprise a bottom wall and a back wall, where the bottom and back walls may connect to at least a portion of the side walls. The bottom wall may assist in forming a cavity to retain a latch bolt, however, the latch bolt may also be retained by other means, such as, but not limited to, a lip on the end of the side walls, etc.

A latch bolt with a tapered nose may be disposed in the housing so that the nose extends out from an opening in one end of the housing, and be biased into an extended position. The nose may be designed and shaped to co-act with a side jamb flange. Biasing may be accomplished by a spring means such as, but not limited to, a compression spring, a tension spring, etc. Protrusions or stops or other such features may be provided on the latch bolt or the housing or both the latch bolt and the housing, to limit the travel of the latch bolt in the extended position. The latch bolt may comprise a top wall, a pair of side walls, a bottom wall, and a rear wall. A raised area on the top wall may protrude through an opening in the latch housing to provide a means of retracting the latch bolt, where the raised area may be in the form of a button. The button may be integral to the latch bolt or may be a separate part that is attached to the latch bolt. The button may be attached to the latch bolt by any number of methods including, but not limited to, bonding, using mechanically fasteners, or, as in the preferred embodiment, using hook-shaped spring clips which are inserted through an opening in the top wall of the latch bolt and thereafter catch upon the underside of the top wall. Also, the top wall may further comprise a recess adjacent to the raised area to provide an increase in the surface area upon which a user may apply a force to toggle the latch bolt.

The latch of this invention further comprises a cantilevered member that occupies a normal "rest" position at an angle to the housing side walls. The cantilevered member may extend from the housing side wall or alternatively from a housing bottom wall, if a bottom wall is incorporated as part of the latch housing. The cantilevered extension may be an integral part of the housing side or bottom wall, and may be formed so as to normally protrude away from a vertex on the housing, at an angle relative to the side wall. As an alternative to forming the cantilevered member as an integral part, a separate part or wall segment may be connected to the housing to function in the same manner as the integral member.

Biasing of the cantilevered member may be employed to maintain contact between the cantilevered member of the latch housing and the window structure. With an embodiment where the cantilevered member is integral to the housing side or bottom wall, biasing may be accomplished in a number of ways, including, but not limited to, incorporating a spring to bias the cantilevered member into the angular position, where the connection around the region of the vertex is merely a flexible connection. Another biasing scheme for an integral cantilevered member may involve forming the connection between the cantilevered member and the housing, around the region of the vertex, from a resilient material. With this means of biasing, the forming of the connection around the vertex must be such that the cantilevered extension should normally occupy an unstressed, "rest" position while extended at an angle to the housing, such that deflecting the cantilevered member so as to be pressed up against the housing would created stored elastic strain energy in the resilient connection. Once the force that deflected the cantilevered member up against the housing was released, as the latch is installed in the window, the stored strain energy would seek to return the cantilevered member to the angled position. The restorative force of the resilient connection would enable positive contact between the cantilevered extension and the window's top wall of the top rail.

The biasing of a separate cantilevered member in the form of a wall segment offers similar as well as other possible configurations of the invention. The wall segment, comparable to the integral cantilevered member, may have either flexible material at the vertex accompanied by biasing with a spring, or it may have resilient material around the vertex which normally biases the cantilevered member to the angled position. The separate cantilevered member in the form of a wall segment may need to be attached to the housing. Attaching a separate side wall segment, while providing either the flexible or the resilient vertex region, may entail having a flange extending away from the vertex and opposite the cantilevered portion, where such a flange may provide an area for accomplishing attachment to either the housing side wall or bottom wall. Attachment of this flange could include, but is not limited to, use of mechanical fasteners, bonding of the flange to the housing, etc. A separate wall segment may alternatively be attached to the housing with a hinged connection. With a hinged connection, the wall segment would be free to rotate and would need a means of biasing the wall segment to the angled position, which may include, but is not limited to, a compression spring.

The location of the vertex on the housing, as well as the length of the cantilevered member, may vary, and both may be designed to assure positive contact of the cantilevered member with the window structure. The closer to an end of the housing that the vertex is located, the longer may be the length of the cantilevered member. A longer cantilevered member that is properly biased would naturally be able to accommodate greater deformations in the window frame and still maintain contact. Also, locating the vertex of a cantilevered member in close proximity to one end may permit use of a plurality of such cantilevered members on one side of the housing, and in addition, a plurality of cantilevered members may be utilized on both sides of the housing. Furthermore, the cantilevered member may have a vertex and arrangement such that the cantilevered member angles away from the housing, with the displaced end of the cantilevered member disposed towards the interior of the window. Alternatively, as in a preferred embodiment, the vertex and arrangement may be such that the cantilevered member angles away from the housing, with the displaced end of the cantilevered member disposed towards the stile of the window.

For any of these possible configurations, installation of the latch bolt may be accomplished through an opening in the window stile that matches the end profile of the latch, and with an opening in the top wall of the top rail contoured to match the housing side walls and back wall. When installing the latch in the window by inserting the latch into the opening, the cantilevered member may need to be pushed against the latch housing until it is past the opening, in order to prevent it from catching on the opening. The latch may be retained in the window opening by have a flexible or a resilient retaining tab on the housing side walls or bottom wall that, after insertion of the latch into the window opening, catches on the window stile and prevents the latch from working its way out from the installed position.

A typical pivotable sash window would include installation of two such latches—one on each of the two stiles. As such, the two latches may be in the form of a left-hand latch, and a mirror image version, or a right-hand latch.

OBJECTS OF THE INVENTION

It is an object of this invention to provide a latch to be installed in the top rail of a sash window of a single-hung or a double hung window assembly.

It is an object of this invention to provide a latch which permits a sash window of a single-hung or a double-hung window assembly to tilt inwardly.

It is a further object of this invention to provide a latch in which the latch may be easily installed in the sash window frame of a hung window.

It is a further object of this invention to provide a latch in which the latch bolt may be installed in the sash window frame without the use of mechanical fasteners.

It is another object of this invention to provide a latch that can be retained by the sash window frame under conditions in which the window experiences severe deformation.

It is another object of this invention to provide a latch that can be retained by the sash window frame during the sustained winds of a hurricane.

DETAILED DESCRIPTION OF THE PREFERRED EMBODIMENT

Figure 1:
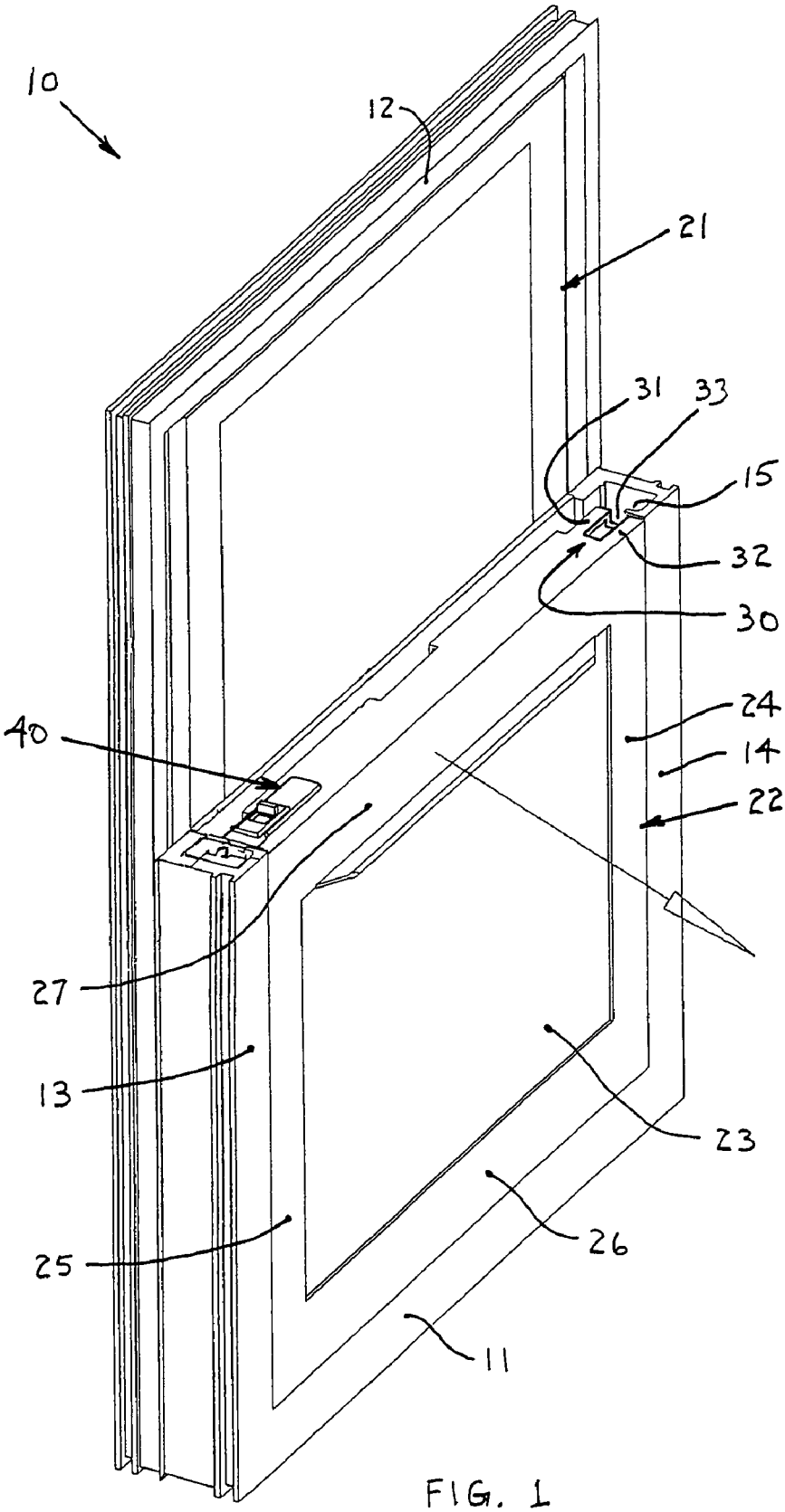
FIG. 1 is a perspective view of a tiltable sash window utilizing the latch of this invention, with part of the master window frame removed to reveal latch details.

A left-hand latch assembly 40 may be provided for installation in a single-hung or double-hung window assembly 10, as shown in FIG. 1. The tiltable single-hung or double hung window 10 has an upper sash window 21, lower sash window 22, and a master frame consisting of a sill portion 11, a head jamb 12, and side jambs 13. Portions of the head jamb 12 and the side jambs 14 have been cut away in the figure in order to illustrate the features of the jamb with which the latch interacts. The lower sash window 22 is comprised of bottom rail 26, top rail 27, and stiles 24 and 25, which support the edge of the glazing, or glass pane 23. As is common for tiltable single-hung or double-hung sash windows, the lower portion of the window has a connection to the frame (not shown) which is both pivotable and slidable with respect to the frame. The upper portion of the window may have latch 40 with a latch bolt 70 having a nose 76, where latch 40 is also slidable with respect to the jamb, but where the nose 76 may be retracted to permit the lower sash window 22 to rotate inward.

Figure 2:
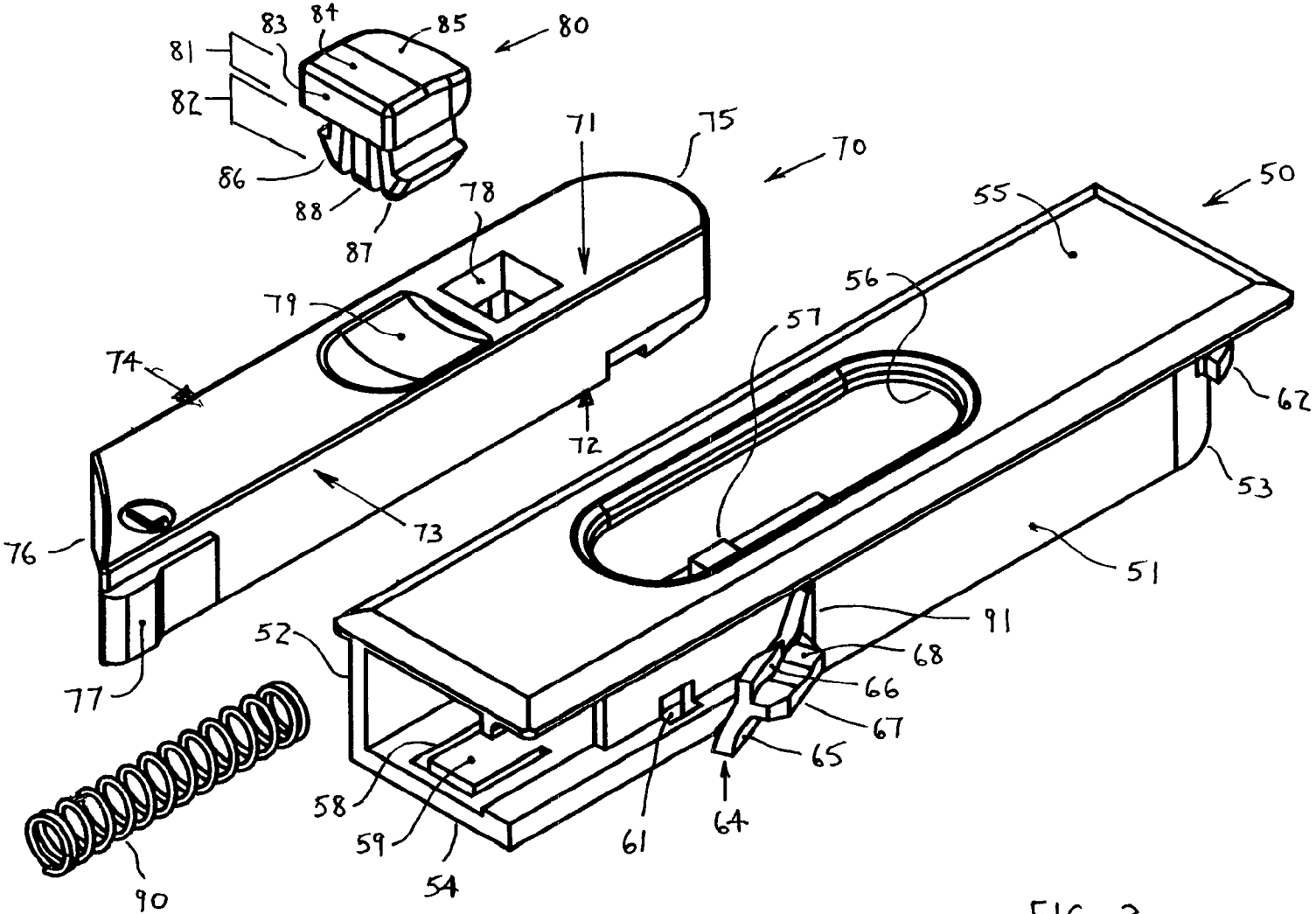
FIG. 2 is an exploded view of the parts comprising a latch embodiment according to the invention.
Figure 4:
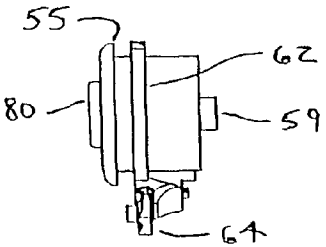
FIG. 4 is a side view of the latch according to the invention.
Figure 3:
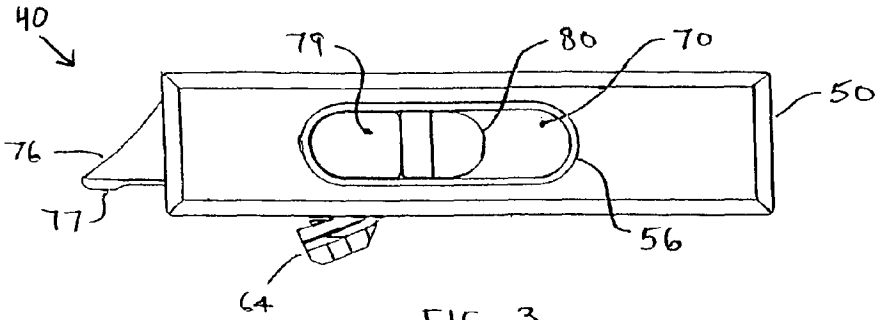
FIG. 3 is a top view of the latch according to the invention.

The latch bolt 70, in a preferred embodiment, may be comprised of a top wall 71, bottom wall 72, first side wall 73 and second side wall 74, as shown in FIG. 2. The latch bolt 70 may have a rear wall 75 connecting at least a portion of the first and second side walls, but in a preferred embodiment, a rear wall 75 is formed only by the thickness of the end of top wall 71, and has a semi-circular shape. The latch bolt 70 may have a nose 76 which may be angled from the second side wall 74 towards the first side wall 73 to form a pointed edge. The first side wall 73 may, near the pointed edge of the nose 76, have a step feature which may be specially designed to co-act with the side jamb flange 15 of the window 10.

The latch bolt 70 may have a recess 79 in the top wall 71 which may be accessible to the user through an opening 56 in the top plate of the housing 50. The opening 56 may take many different forms including, but not limited to, a circular opening, a rectangle, an oval, a polygon, etc, and must merely accommodate access to recess 79. In a preferred embodiment the opening 56 is a race-track shape with two straight sides connected by two semi-circular edges. The recess 79 may permit the user—using a thumb, thumb nail, finger, finger nails, or a tool—to toggle the latch bolt from the extended to the retracted position. To permit easier toggling, the latch bolt may have, in place of or in addition to recess 79, a protruding or raised portion, which in a preferred embodiment, is in the form of a button 80. The button 80 of a preferred embodiment may have an exposed portion 81 and a non-exposed portion 82, where the non-exposed portion 82 may contain features to facilitate attachment of the button to the latch bolt 70.

The exposed portion 81, in a preferred embodiment, may have a front face 83, a top face 84, and an angled back face 85, such that the front face 83 would provide an easily graspable surface to enable the user to toggle the latch bolt.

Figure 8:
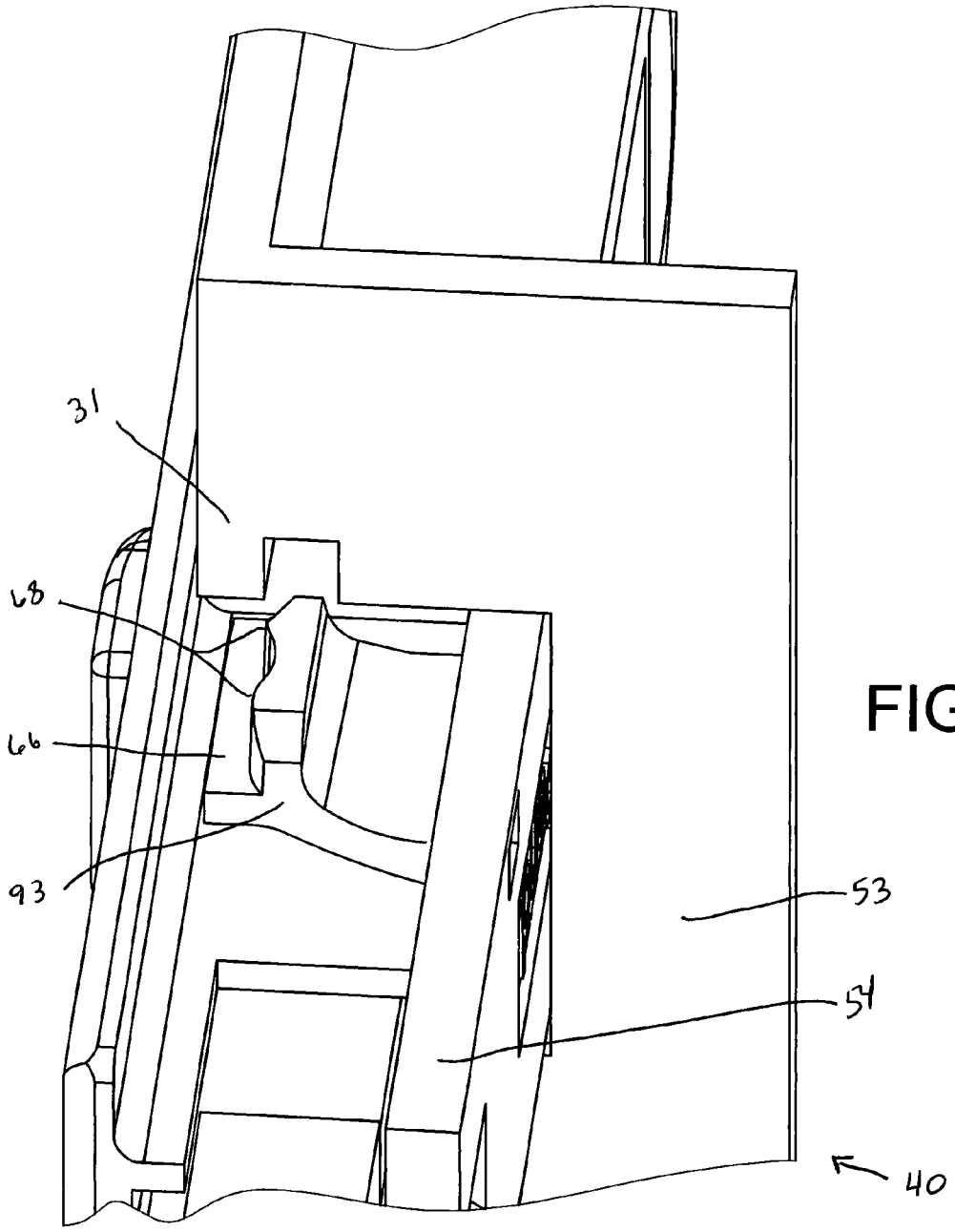
FIG. 8 is an enlarged perspective view of an alternate embodiment of the cantilevered member of the latch, as the latch is installed into an opening in a sash window stile and top rail.

The non-exposed portion 82, in a preferred embodiment, may have first and second hooked extensions or spring clips 86 and 87, which may be inserted into an opening 78 in the top wall 71 of latch bolt 70. The spring clips 86 and 87 and the opening 78 may be formed so as to require the spring clips to be deflected towards each other to pass through the width of the opening during installation. Once the underside of top portion 81 of button 80 contacts the top wall 71 of the latch bolt 70 during installation, the spring clips may rebound back to a natural undeflected position so that the hooks catch on the underside of the top wall 71 of the latch bolt 70 to fix the button 80 to the latch bolt 70. The opening 78 may take many different forms including, but not limited to, a circular opening, a rectangle, an oval, a figure-8, a polygon, etc, and must merely accommodate the hooked extensions 86 and 87. In a preferred embodiment the opening is square shaped.

A spring 90 may be used to bias the latch bolt 70 to normally occupy an extended position, such that the nose 76 of the latch bolt 70 protrudes from an opening in the housing 50. Spring 90 may be a tension spring or a compression spring, depending on its placement relative to latch bolt 70 and housing 50. In a preferred embodiment, spring 90 is a compression spring. The travel of the latch bolt 70 relative to housing 50 may be limited in a number of ways, but in a preferred embodiment, the housing 50 may have a stop 57, which may be used to contact a flange 88 that protrudes down from the underside of button 80 and prevent the compression spring from causing excessive travel and disengagement of the latch bolt 70 from the housing 50.

The latch 40 may have a housing 50 which may be comprised of a first side wall 51, and a second side wall 52, where at least a portion of each side wall is connected to top plate 55. Although it is not required, a back wall 53 may also connect to at least a portion of the first and second side walls, and may also connect to the top plate 55. Similarly, opposite the top plate may be a bottom wall connecting to at least a portion of the first and second side walls to provide an enclosure within which a latch bolt 70 may translate. However, instead of a bottom wall creating an enclosure, one of several alternative methods to slidably retain the latch bolt may be used, including, but not limited to, rectangular wings protruding from the side of the latch bolt which may be slidably retained by a slot in the first and second housing sidewalls, a lip extending from the first and second side walls, etc.

An opening 30 in the top rail 27 of the lower window 22 exposes a top wall of the rail and creates an outer flange 31 of the rail opening and an inner flange 32 of the rail opening, and also creates a side flange 33 of the stile 24 (FIG. 1).

The top plate 55 may overhang beyond the first side wall 51 and second side wall 52, as well as the back wall 53 if such a back wall is provided, so that upon installation of latch 40 into opening 30 in the top rail 27, the overhanging portion would positively retain the latch 40 on the top rail 27, and prevent the latch from dropping down into the hallow area of the rail.

Figure 5:
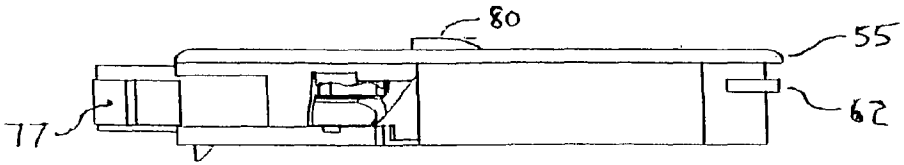
FIG. 5 is a side view of the latch according to the invention.
Figure 6:
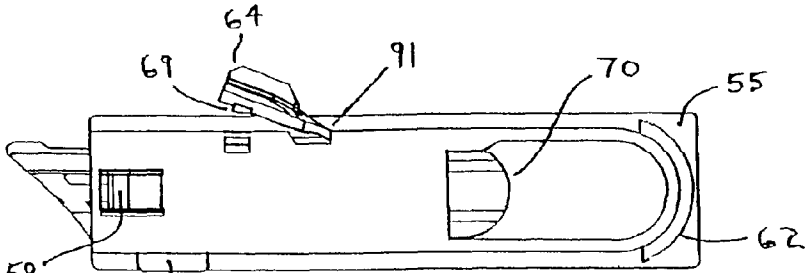
FIG. 6 is a bottom view of the latch according to the invention.
Figure 7:
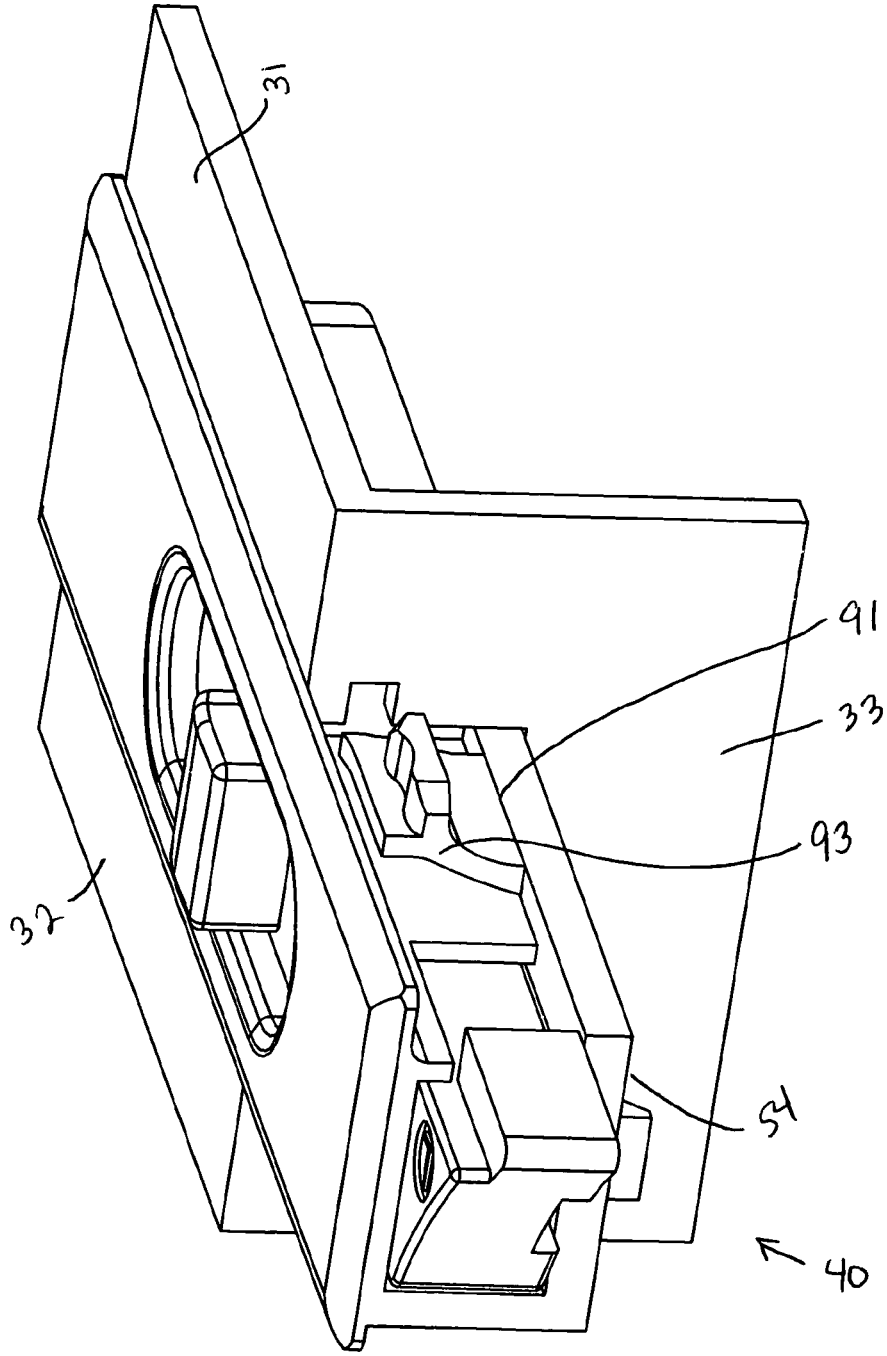
FIG. 7 is a perspective view of an alternative embodiment of the latch being installed into an opening in a sash window stile and top rail.

The second side wall 52, may have a protrusion 63 extending outward from the wall so that when the latch 40 is inserted into the rail slot 30 of the window 22, the inside flange 32 (or the outside flange 33) may be trapped between the top plate 55 and the protrusion 63. Also, where a back wall 53 is incorporated into the housing 50, a similar protrusion 62 on back wall 53 may cooperate with the housing top plate 55 to trap the wall of the top rail at the point where the inside flange 32 and outside flange 33 meet. The protrusion 62 may, for example, have a rectangular cross-sectional shape and a length running along second side wall 52, as shown in FIGS. 5 and 6, but could alternatively comprise other shapes and still be functional. Similarly, protrusion 63 may have a rectangular cross-section and run along a flat or a curved back wall 53. One possible alternative protrusion 93 may have curved surfaces forming peaks and valleys, as shown in FIG. 7.

The first side wall 51 could, in a conventional approach, have a fixed protrusion similar to protrusion 63 on the second side wall, in order to contact the underside of the top plate and cooperate in retaining the latch 40 in the window slot 30. However, to successfully counter severe deformations accompanying high wind loading, first side wall 51, in a preferred embodiment, may have flexibly attached to it a cantilevered member 64 which may have a protrusion 67 extending therefrom. Protrusion 67 may also have a rectangular cross-sectional shape and a length running along the cantilevered member, and may also alternatively comprise other shapes and still be functional.

Figure 9:
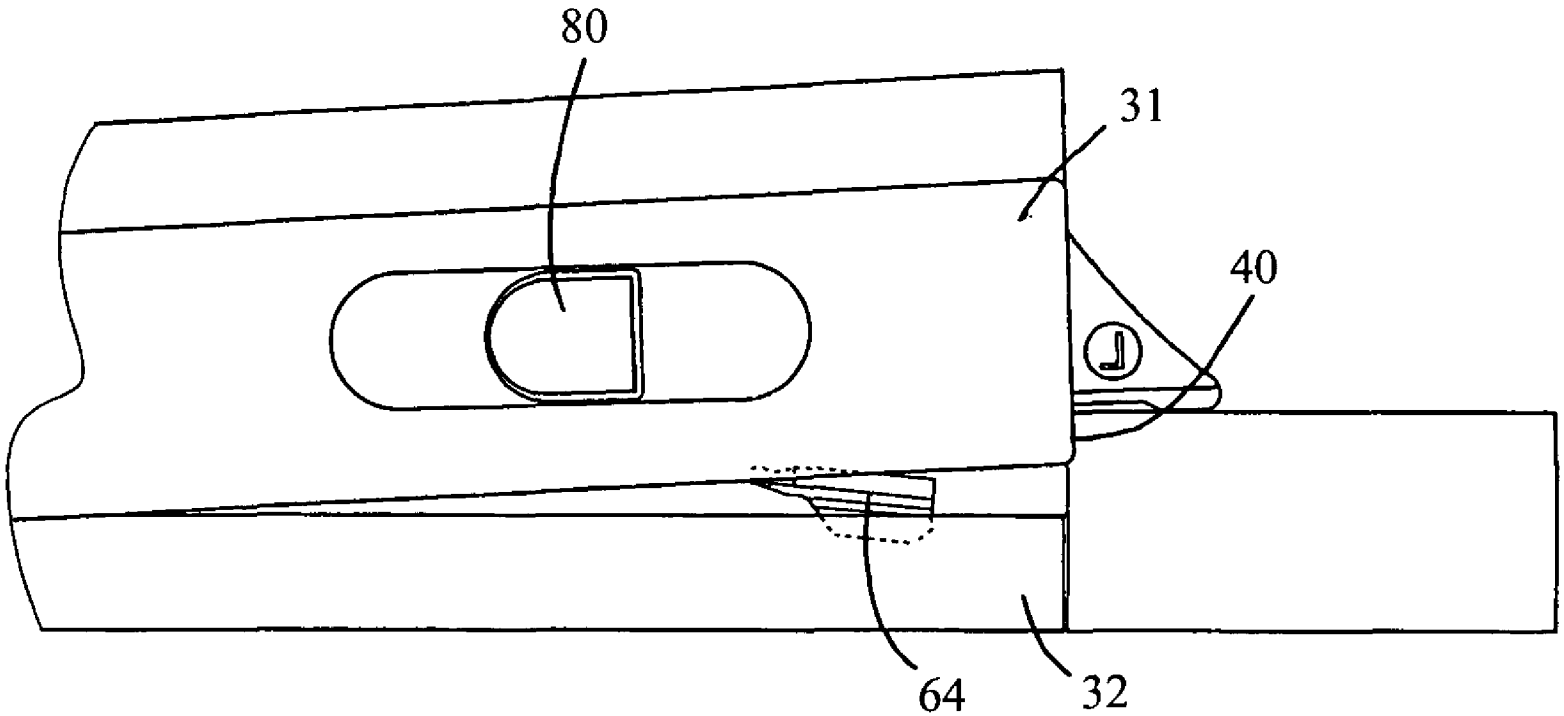
FIG. 9 is an enlarged perspective view of the right-hand latch of this invention with the cantilevered member maintaining the integrity of the latch installation, as the window experiences severe deformation under actual high wind load testing.

In a preferred embodiment of the invention (see FIG. 2), a protrusion 67 extends from a wall of the cantilevered member 64, creating a lower portion 65 and an upper portion 66 of the wall of the cantilevered member. With the latch installed in a pivotable window, where the window experiences severe deformation due to high wind loading, such as shown in FIG. 9, the top area 68 of the protrusion 67 and the upper portion 66 of the cantilevered member 64 will, as a result of biasing, maintain contact with the wall (31 or 32) of the top rail.

A cantilevered member 64 may extend only from first side wall 51, or alternatively cantilevered members may extend from both side walls 51 and 52, or it may extend from one or more locations of bottom wall 54. Where such a cantilevered member 64 extends from the housing 50, it may be configured to have its free end extend a distance beyond the edge of the top plate 55. Also, as the cantilevered member 64 is flexible attached to the housing 50, it may be possible to deflect the cantilevered member 64 or members inward to be flush against the respective housing wall. This inwardly deflected position may aid in installing the latch endwise into opening 30 of the lower window 22, where the opening 30 periphery matches the end profile of the latch, such that the rectangular protrusion 67 may pass through a matching keyway and then be free to expand outward to contact outer flange 31 or inner flange 32 of opening 30. This inward flexibility of the cantilevered member 64 may even be such that it permits the latch to be installed vertically by dropping it down into the opening 30, rather than through an endwise installation. A drop down installation as described would eliminate the need for a keyed feature in the portion of opening 30 formed in the stile (32 and 33) of the window 22. The configuration for this drop down installation may have a cantilevered member 64 that deflects inward, possibly into an opening or a recess in the housing, but to an extent where such deflection positions the protrusion 67 so as to be clear of the flange (31 or 32) of the top rail 27 as the latch drops through opening 30, whereupon the cantilevered member biases outward and contacts the flange.

The cantilevered member may be a separate wall that is hinged to the side or bottom wall; may be attached—mechanically fastened or bonded or the like—to the side wall or to the bottom wall utilizing a flexible connection at the vertex 91; or the cantilevered member may alternatively be an integral portion of the side or bottom wall but with a flexible connection at the vertex 91. The cantilevered member may generally be free at three sides—the top, the bottom, and the protruding edge, and may be connected to the housing on a fourth side.

In a preferred embodiment, the cantilevered member 64 is integral to side wall 51, but normally extends away from side wall 51 at an angle. The connection of the cantilevered member 64 at vertex 91, in addition to being flexible, may be resilient in nature so as to accomplish biasing, whereby applying a force to deflect the cantilevered member towards the side wall so as to parallel the side wall 51, creates stored elastic strain energy in the resilient connection. This stored elastic strain energy seeks to return the cantilevered member to its angular position once the force has been removed. This method of biasing may be utilized whether the cantilevered member 64 is integral to the side wall 51, or if is attached to the side wall.

As an alternative to having the flexible connection being resilient in nature, a spring means may be utilized to bias either the integral or the attached cantilevered member 64. Such a spring means may include, but is not limited to, a compression spring, a torsion spring, etc., which may bias the cantilevered member away from the side wall 51. Where a hinged connection is used to attach a separate wall segment to the housing to serve as a cantilevered member, a spring means may necessarily be used for biasing. During installation of the latch into an opening in the window stile 24 and top rail 27 of the sash window 22, it may be necessary to manually deflect the cantilevered member 64 into a position parallel to the side wall to prevent the cantilevered member from catching or hanging up on the stile.

Cantilevered member 64 may also be positioned on the side wall such that the vertex 91 is near back wall 53, and may have a length equal to the length of the housing, to accommodate severe deformations and still maintain positive contact with the wall of the top rail. Similarly, the first and second side walls 51 and 52, although shown as having a very shallow depth in a preferred embodiment in FIG. 2, may actually extend to a greater depth, and may thus be capable of supporting a cantilevered member having a substantial vertical dimension. Also, although not shown in the figure, an embodiment could include having a pair of cantilevered members extending from each side of the latch, whereby a first cantilevered member could maintain contact with outer flange 31 of the top rail and a second cantilevered member could maintain contact with inner flange 32 of the top rail.

Another possible embodiment may include a plurality of cantilevered members 64 on each side wall (51 and 52), or on each side of the bottom wall 54. It should be noted that for any of these possible embodiments, the cantilevered member 64 may have a vertex 91 and orientation such that the cantilevered member 64 angles away from the housing, with the displaced end of the cantilevered member 64 disposed towards the interior of the window 22. Alternatively, as in a preferred embodiment, the vertex 91 and orientation of the cantilevered member 64 may be such that the cantilevered member 64 angles away from the housing, with the displaced end of the cantilevered member 64 disposed towards the stile 24 of the window 22.

It should be apparent from basic geometry that for a given angular deflection of cantilevered member 64, that the greater the length of the cantilevered member, the greater the distance its end would be positioned away from the housing 50 side wall, and thus be capable of accommodating greater window deformations caused by wind loading, as the member would still be capable of maintaining contact with the wall of the top rail to support the latch.

Since the cantilevered member 64 would be constructed to normally extend away from the housing 50 at an angle, which would not be ideal for shipping of the product and could lead to damage to the cantilevered member, the lower portion 65 of the cantilevered member 64 may further comprise a small protrusion 67. Protrusion 67 of the cantilevered member 64 may, with the cantilevered member pushed flush against the housing 50 side wall, fit into an opening 61 in the housing 50 to prevent the cantilevered member from deflecting outward until the protrusion 67 of the cantilevered member is deliberately disengaged, at which point the cantilevered member may swing into its angled position for installation into a slotted opening 30 of a tiltable sash window 10. To assist in fitting the protrusion 67 of the cantilevered member 64 into the opening 61, the lower portion 65 of the cantilevered member may have some slight curvature, as seen in FIG. 2.

To complete endwise installation of the latch 40 through an opening 30 in the stile 24, a retaining tab 59 may be formed on bottom wall 54 of housing 50. The retaining tab 59 may protrude down away from the bottom wall 54, so that once installed, it would contact side flange 33 of the stile 24, to prevent the latch 40 from working its way out of the slotted opening 30. To assist in installing the latch 40, the retaining tab 59 and even the entire bottom wall 54 may be constructed of resilient material. As an alternative, there may be a gap 58 in the bottom wall 54 around retaining tab 59, which would permit some flexibility of the retaining tab 59 and allow it to be deflected inward as the latch were slid into the slotted opening 30.

Other modifications, substitutions, omissions and changes may be made in the design, size, materials used or proportions, operating conditions, assembly sequence, or arrangement or positioning of elements and members of the preferred embodiment without departing from the spirit of this invention as described in the following claims.

We claim:

1. A latch, for use in a sash window of a single-hung or double-hung window assembly, said latch comprising:

a housing, said housing comprising: a top plate; a first side wall, a second side wall, and a rear wall connecting to said first and second side walls, said first and second side walls and said rear wall each extending down from said top plate and being connected at a distal end by a bottom wall to form at least a first opening into a cavity; said top plate extending a distance beyond at least said first and second side walls; and said housing further comprising one or more cantilevered members being integral with a portion of said first side wall and having a vertex on said first side wall being in a vertical direction, said housing further comprising a first protrusion protruding from said second side wall and a second protrusion protruding from said rear wall, said cantilevered member having a resilient connection with said first side wall to bias said cantilevered member to be angled with respect to a portion of said first side wall so that a free end of said cantilevered member, being distal from said vertex, extends beyond said top plate, said cantilevered member having a protrusion extending away from a side of said cantilevered member; said first protrusion on said first wall, said second protrusion on said rear wall, and said protrusion on said cantilevered member being generally offset the same amount from a bottom surface of said top plate;

a latch bolt, said latch bolt disposed in said cavity of said housing wherein at least a portion of said latch bolt protrudes from said first opening in said housing; and a spring, said spring biasing said latch bolt into an extended position.

2. The latch according to claim 1 wherein said back wall is curved.

3. The latch according to claim 1 wherein said bottom wall further comprises a retaining tab.

4. The latch according to claim 3 wherein said retaining tab protrudes down from said bottom wall.

5. The latch according to claim 4, wherein said bottom wall and said retaining tab are constructed of resilient material.

6. The latch according to claim 4 wherein a gap is formed between said bottom wall and at least a portion of the periphery of said retaining tab.

7. The latch according to claim 6 wherein said gap between said bottom wall and said portion of the periphery of said retaining tab permits flexing of said retaining tab.

8. The latch according to claim 4 wherein said retaining tab is near said first opening in said housing.

9. The latch according to claim 1 wherein said latch further comprises a means for retracting said latch bolt.

10. The latch according to claim 1 wherein said spring comprises a compression spring.

11. The latch according to claim 1 wherein said spring comprises a tension spring.

12. The latch according to claim 1 wherein said housing further comprises a stop, said stop located on said housing to contact a latch bolt feature to limit said biasing of said latch bolt in said extended position.

13. The latch according to claim 1 wherein said vertical vertex of said cantilevered member is at a position on said first side wall being between a first end of said first side wall proximate to said housing first opening, and said rear wall.

14. The latch according to claim 13 wherein said vertex of said cantilevered member is more preferably at a position on said first side wall being between said first end of said first side wall and a midpoint of said first side wall.

15. The latch according to claim 1 wherein said cantilevered member is biased out from a recess in said first side wall; and wherein said housing further comprises a second opening in said recess and said cantilevered member of said housing further comprises a second protrusion extending generally parallel with said cantilevered member, said second protrusion of said cantilevered member capable of nesting within said second opening when said cantilevered member is in positioned approximately parallel to said housing.

16. A latch, for use in a sash window of a single-hung or double-hung window assembly said latch comprising:

a housing, said housing comprising: a top plate, one or more walls having a first end being connected to and extending away from said top plate, and a bottom wall connecting at least a portion of a second end of said one or more walls to form a cavity; said one or more walls comprising a first opening into said cavity at a first end of said housing; said top plate overhanging beyond said one or more walls; said housing further comprising: a cantilevered member being integral with a portion of said one or more walls and having a vertex on a first side of said housing being in a vertical direction, a first protrusion on said one or more walls protruding from a second side of said housing, and a second protrusion on said one or more walls protruding from a second end of said housing, said cantilevered member having a resilient connection with said one or more housing walls to bias said cantilevered member to be angled with respect to a portion of said one or more walls so that a free end of said cantilevered member, being distal from said vertex, extends beyond said overhanging portion of said top plate, said cantilevered member having a protrusion extending away from a side of said cantilevered member;

a latch bolt, said latch bolt being slidable within said housing cavity between a retracted position and an extended position where at least a portion of said latch bolt protrudes from said first opening in said housing; and a spring, said spring biasing said latch bolt into said extended position.

17. The latch according to claim 16, wherein said vertical vertex of said cantilevered member is at a position on said first side of said one or more housing walls being between said housing first end and said housing second end.

* * * * *